US006158623A

United States Patent [19]

Benavides et al.

[11] Patent Number: 6,158,623

[45] Date of Patent: Dec. 12, 2000

[54] PACKAGING OF FLOWABLE PRODUCTS

[76] Inventors: Samuel B. Benavides, P.O. Box B1, Pacific Grove, Calif. 93950; Joseph R. Garrison, 11842 Daniel Ave., Garden Grove, Calif. 92840

[21] Appl. No.: 09/406,503

[22] Filed: Sep. 28, 1999

Related U.S. Application Data

[63] Continuation-in-part of application No. 09/065,151, Apr. 23, 1998.

[51] Int. Cl.[7] ..... B67D 5/56

[52] U.S. Cl. ..... 222/129; 222/185.1; 222/547

[58] Field of Search ..... 222/185.1, 142.4, 222/480, 547, 565, 548, 129

[56] References Cited

U.S. PATENT DOCUMENTS

| | | |
|---|---|---|
| 110,473 | 12/1870 | Kennedy . |
| D. 296,405 | 6/1988 | Weaver . |
| D. 326,983 | 6/1992 | Elmore . |
| D. 335,242 | 5/1993 | Saunders . |
| D. 345,085 | 3/1994 | Sewell . |
| 748,329 | 12/1903 | Williamson . |
| 1,215,018 | 2/1917 | Grossman . |
| 1,646,322 | 10/1927 | Smith . |
| 1,927,149 | 9/1933 | Belefant . |
| 2,773,628 | 12/1956 | Gabler . |
| 2,922,551 | 1/1960 | Osaka . |
| 3,122,275 | 2/1964 | Maxim . |
| 3,485,416 | 12/1969 | Fohrman . |
| 3,735,899 | 5/1973 | Rollinson . |
| 4,193,521 | 3/1980 | Bounds . |
| 4,277,000 | 7/1981 | Jaarsma . |
| 4,703,874 | 11/1987 | Tapperman et al. . |
| 4,961,521 | 10/1990 | Eckman . |
| 4,993,584 | 2/1991 | Macario . |
| 5,275,308 | 1/1994 | Gamberini . |

*Primary Examiner*—Gregory L. Huson
*Assistant Examiner*—Thach Bui
*Attorney, Agent, or Firm*—Leo F. Costello

[57] ABSTRACT

A container for handling bulk flowable products including a housing having opposed first and second end walls and opposed first and second side walls, a partition in the housing dividing it into first and second compartments, an outlet for each compartment respectively adjacent to opposite ends of the housing; and closures for the outlets. The partition is sloped toward each outlet so that when its closure is opened, the product in the corresponding compartment flows through the outlet and is dispensed. In effect, the container is comprised of two, back-to-back, funnel-shaped compartments that are inverted relative to each, with outlets from the compartments adjacent to the respective throats of compartments. A method of using the container is also disclosed and involves storing the same or different products, and if different which may be related but do not have to be, in the two compartments and selectively dispensing the product or products through the outlets without having to pick up the container except to invert it for dispensing product from the other compartment. The container and method are especially suited for containing and dispensing dry bulk rice and beans but are applicable to many other flowable products, both solid and liquid.

51 Claims, 9 Drawing Sheets

PACKAGING OF FLOWABLE PRODUCTS

RELATED APPLICATION

This application is a continuation-in-part of the pending application of applicant Samuel B. Benavides, Ser. No. 09/06515, filed Apr. 23, 1998, entitled Rotary Dispensing System, and which is incorporated in its entirety by reference herein

FIELD

The present invention pertains to the packaging of flowable products and more particularly to a container for transporting, storing, dispensing and otherwise handling flowable products contained therein and to a method of using the container.

BACKGROUND

The present invention is concerned primarily with the handling of certain flowable products in bulk form, on both wholesale and retail levels. More specifically, the invention is directed to the packaging of such products to facilitate transporting, storing and dispensing them. The products include a wide variety of primarily dry, bulk products, like rice and beans, but may also include certain liquids.

Mexican and Chinese restaurants in particular use rice and beans in large quantities on a daily basis and thus purchase and store them in large-size containers. Currently, bulk rice is typically bought and stored by the restaurant trade in twenty-five and fifty pound paper or plastic bags and dispensed from such bags during food preparation. Although this has been the practice for many years, there are several problems with the use of such bags for these dry bulk products. Paper bags are subject to puncture, breakage, and invasion by rodents and other pests during handling and storage of dry bulk products by both the restaurant supply and the restaurant. Moreover, such large, heavy bags are awkward to grasp and, for by certain personnel, may be too heavy or cumbersome for lifting, carrying, and dispensing. In addition, once the bags are opened, the product may lose freshness since the bag may not be closed nor be capable of subsequent tight closure. Also, the non-rectilinear shape of bags when full, and their irregular shapes when partially full, prevent their storage in an efficient manner.

A restaurant typically stores rice and beans in their separate bags in which they were purchased and dispenses them from these bags during food preparation. In one way of dispensing, a bag is lifted, opened and then tipped so that a certain amount flows by gravity into a cup, basin or other container. Afterwards, the bag is returned to its storage location, with closure being somewhat problematical. Such handling may result in spillage and waste not only during dispensing but during subsequent storage; it also may cause unwanted overflow into other foods being prepared, may make gauging the amount dispensed more difficult, and may be tiring especially when the bags are full. Another way of dispensing is to scoop the product out of an open bag, in which case some of the same problems remain. For typical Mexican menu items and for other preparations, the packaging and dispensing methods described above require accessing two separate bags, one for rice and one for beans, so that the process is repeated twice.

In addition to such commercial establishments, households or other organizations may buy, store and dispense large quantities of dry bulk or liquid products wherein certain of the foregoing problems also exist. Furthermore, there are also a multitude of other flowable products besides rice and beans, both dry and liquid, where improved packaging might improve storage and dispensing of the product. Such products may include many dry bulk products, food or otherwise, such as pet foods, cereals, coffees, pastas, nuts, jelly beans, and powdered milk, laundry and washing detergents, marbles, BB's fertilizer pellets, injection molding pellets and may include many liquid products, such as bulk wines, juices, drink mixes, and water.

With certain of these products that are related during serving or use, like rice and beans but also different pet foods, different cereals, and different detergents, for example, their packaging in separate containers may add to the storing and dispensing inefficiencies noted above, both in commercial and domestic applications. If on a regular basis, a user desires to mix products together for consumption, for example two different cereals, it is necessary to access two different boxes or other containers.

Applicants are unaware of any packaging that addresses or solves the foregoing problems. Paperboard containers intended to hold and dispense single bulk products are of course notoriously old, but they require the package to be lifted and tipped to dispense the product, and they have other shortcomings insofar as the problems discussed above are concerned. Plastic dispensing bins are disclosed in the Elmore, Saunders and Weaver U.S. Pat. Nos. Des. 326,983; Des. 335,242; and Des. 296,405, respectively, but these are intended to be filled by the user from packages in which the product was purchased; are not suitable for distributing the product; waste space in the container that might otherwise contain more product; and are incapable of separately containing and dispensing one or two products from separate compartments in the container. Dual condiment dispensers, for salt and pepper for example, have long been known, such as disclosed in the Bounds U.S. Pat. No. 4,193,531, but these are unsuitable for containing and dispensing large quantities of flowable products, they must be tilted to dispense the product, and they are unable selectively to dispense substantially all of their contents in a controlled manner merely by gravitational flow.

SUMMARY

A container for handling bulk flowable products is disclosed and includes a housing having opposed first and second end walls and opposed first and second side walls, a partition in the housing dividing it into first and second compartments, an outlet for each compartment respectively adjacent to opposite ends of the housing; and closures for the outlets. The partition is sloped toward each outlet so that when its closure is opened, the product in the corresponding compartment flows through the outlet and is dispensed. In effect, the container is comprised of two, back-to-back, funnel-shaped compartments that are inverted relative to each, with outlets from the compartments adjacent to the respective throats of the compartments. A method of using the container is also disclosed and involves storing the same product, or different products in the container. If different, the products may be related but do not have to be. Product or products in the two compartments are selectively dispensed through the outlets without having to pick up the container and tilt it, as is commonly done, except to invert the container into a dispensing position corresponding to the product to-be-dispensed. The container and method are especially suited for packaging dry bulk rice and beans but are applicable to many other flowable products, both solid and liquid.

An object of the present invention is to improve the packaging of flowable products such as dry bulk products, but also certain liquid products.

Another object is to facilitate the transportation, storing, dispensing and other handling of flowable products in a container.

A further object is to provide a container for receiving dry bulk products that is easier to store, carry and manipulate by personnel using the container.

An additional object is to be able to dispense flowable products from a container without having to lift and tilt the container and yet to facilitate placement of the container in various orientations for dispensing or storage purposes. Another object is to enable products to be dispensed from a container that can be manually picked up but does not have to be picked up to dispense products.

A further object is to be able to dispense products from any particular compartment of a multi-compartment container while the container remains stationary but to be able to select a different compartment from which to dispense product merely by changing the orientation of the container.

An additional object is to preserve the freshness of products being dispensed from a container.

Yet another object is to provide a container with multiple compartments that contain product wherein product can be selectively obtained by gravitational flow from a compartment while the container remains in a single position and then merely by changing the orientation of the container, product can be similarly obtained from another compartment.

A still further object is to provide a container with multiple compartments capable of containing the same product in all the compartments or different products in different compartments so that product can be dispensed in selected quantities from any one of the compartments while the container remains in one orientation but, by inverting the container, product can be similarly dispensed from another compartment.

Yet another object is to provide a container that has application for containing and dispensing flowable products, either dry bulk products or liquid products, either in commercial or domestic uses.

An additional object is to provide a container that is particularly suited for use by restaurants that specialize in the serving of two different dry bulk products that must be dispensed in large quantities on a daily basis.

Another object is to be able to determine through the container wall how much product remains in a container as product is dispensed therefrom.

Another object is to provide a container that may be made in traditional paperboard or plastic or other materials and which may be opaque, transparent or translucent, depending on the particular application.

A still further object is to provide a container having the ability to dispense dry bulk products and which can be designed to dispense products merely by their gravitational flow depending upon the particular characteristics of the products and especially their flow rates given certain angles of repose.

An additional object is to provide a container that dispenses products by gravitational flow without lifting and tilting the container and that allows the flow rate to be controlled depending on the product to be dispensed.

These and other objects, features and advantages of the present invention will become apparent upon reference to the following description, accompanying drawings, and appended claims.

DETAILED DESCRIPTION

Figure 1:
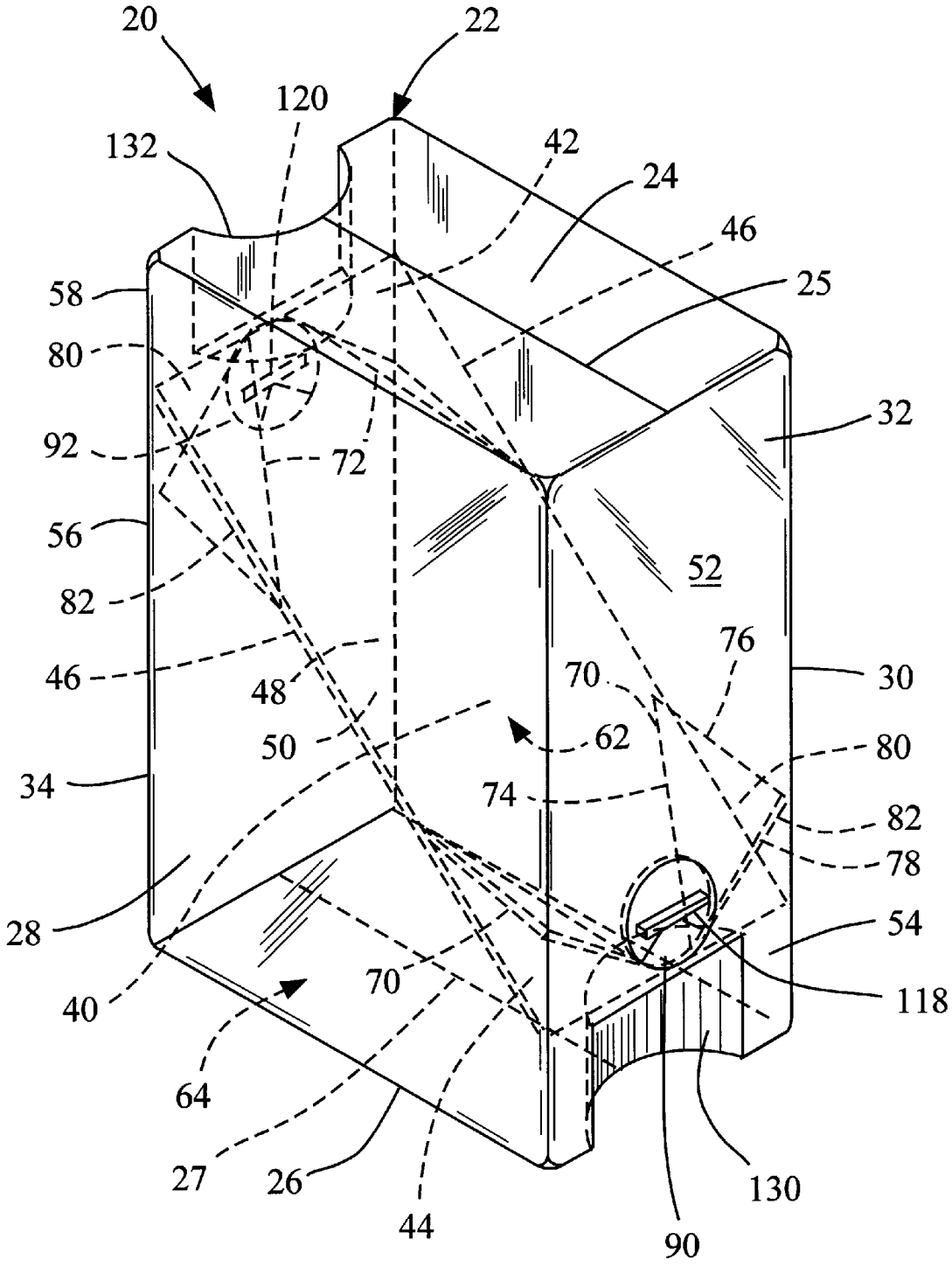
FIG. 1 is an isometric view of a first embodiment of a container incorporating the principles of the present invention with hidden portions shown in dashed lines.
Figure 3:
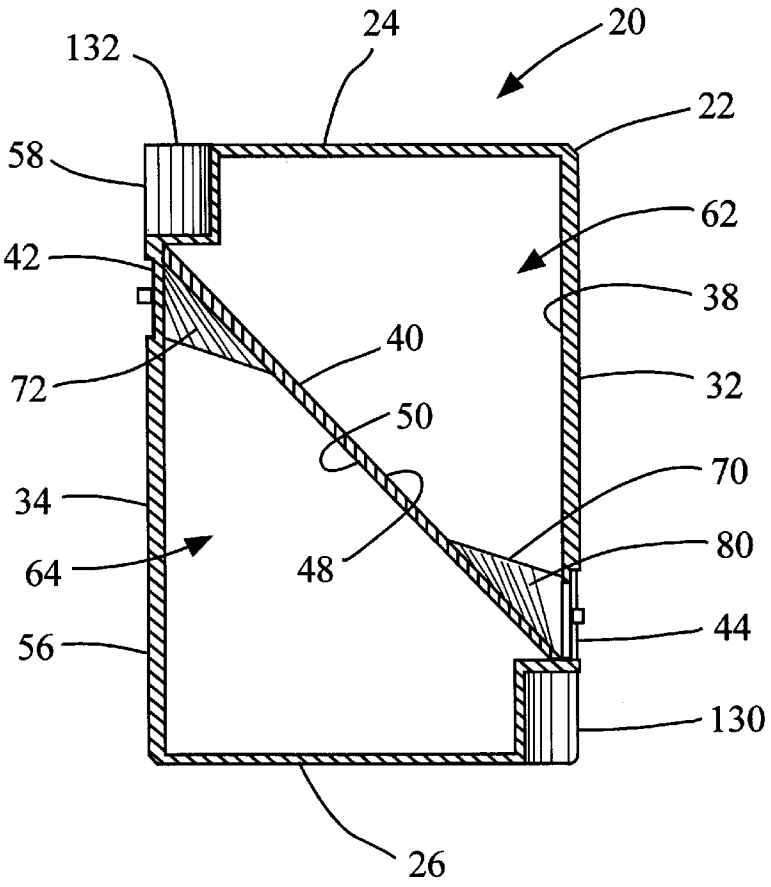
FIG. 3 is a vertical section taken on line 3—3 in FIG. 2.
Figure 2:
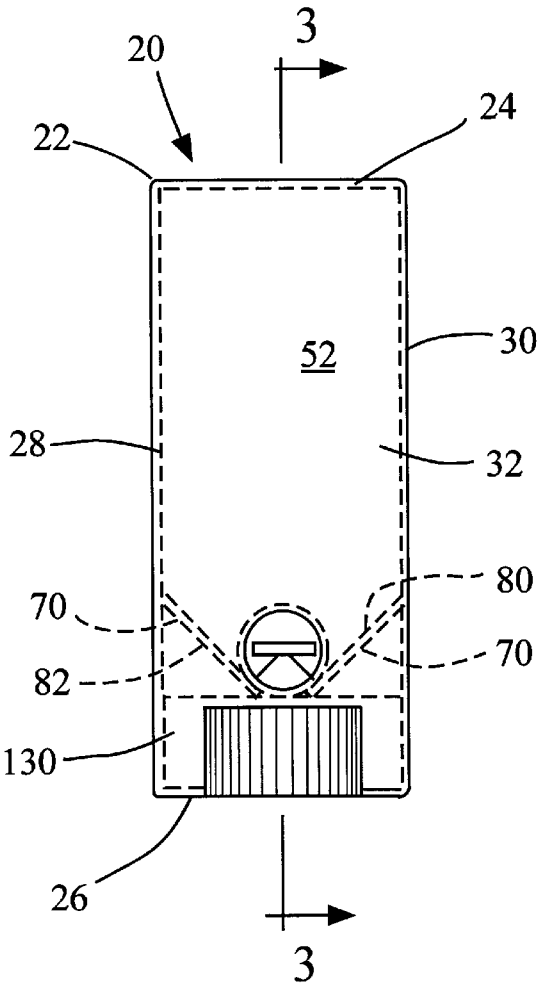
FIG. 2 is a side elevation of one side of the container shown in FIG. 1, which may be considered one of the front sides of the container, but on a scale somewhat reduced from that shown in FIG. 1.

With reference to FIGS. 1–3, a first embodiment of a container incorporating the principles of the present invention is generally indicated by the number 20. In this first embodiment of the invention, the container may be made of paperboard, that is cardboard, such as is commonly used for cereals and other dry bulk products. Although paperboard is preferred for this embodiment, plastic or other materials may be used. Furthermore, since paperboard is the preferred material, the container is opaque but if plastic were to be used, the container could be either opaque, transparent, or translucent. The container includes a housing 22 which preferably has the shape of a rectangular parallelepiped or polyhedron. As the description proceeds, however, it will be understood that the container could have other shapes, such as cylindrical, although the orthogonal, rectangular parallelepiped or polyhedral shape is preferred for achieving certain objectives of the invention. Depending on the product to be packaged in the container, and such factors as the strength, rigidity, and weight that are necessary and desired for the product and the package as a whole, the thickness, gauge or ply of the paperboard may vary from ⅛" to ⅜". Similar considerations exist if plastic or other materials are used as the material. The thickness selected for the material is well within the skill of the art and is not part of the present invention, being mentioned here since it is a consideration in the design of any particular container embodying the principles of the present invention.

The housing 22 (FIGS. 1–3) includes opposed first and second end walls 24 and 26, having end flaps 25 and 27, respectively; that are closed and sealed when the package is complete, opposed first and second wide side walls 28 and 30, respectively; and opposed first and second narrow side walls 32 and wall 34, respectively. In this first embodiment, each of these walls is planar and rectangular, with the first and second end walls having the same shape and size, with the first and second wide side walls having the same shape and size, and with the first and second narrow side walls having the same shape and size. The container, although preferably of parallelepiped shape, is not limited to rectangular cross-sections since the principles of the invention are applicable to a container having square cross-sections. Moreover, the names given to the walls, i.e., "side" and "end" are not intended to limit the orientation of the container, but merely to indicate the more common positions of the container in its preferred applications. Depending on the orientation of the container in any particular application, the walls may assume upper, lower, front, rear, left or right orientations, since the container may be placed in any of six possible positions depending on the situation, as will be seen.

By way of definition and for subsequent reference (FIGS. 1–3), the housing 22 has a length dimension measured from the first end wall 24 to the second end wall 26, a width dimension measured from the first narrow side wall 32 to the second narrow side wall 34, and a depth dimension measured from the first wide side wall 28 to the second wide side wall 30.

The container 20 (FIGS. 1–3) also includes a planar rectangular partition or ramp 40. The partition extends obliquely and almost diagonally within the housing 22 between the first narrow side wall 32 and the second narrow side wall 34, as shown in dashed lines in FIG. 1 and in solid lines in FIG. 3. The partition has a first end 42 integrally secured to the second narrow side wall 34 in inwardly spaced relation to the first end wall 24, a second end 44 integrally secured to the first narrow side wall 32 in inwardly spaced relation to the second end wall 26, and opposite side edges 46 respectively integrally secured to the first and second wide side walls 28 and 30, and opposite first and second surfaces 48 and 50. As such, the partition divides the first narrow side wall 32 into a long first end portion 52 and a short second end portion 54. Similarly the partition divides the second narrow side wall 34 into a long first end portion 56 and a short second end portion 58.

The partition 40 (FIGS. 1–3) also divides the interior of the housing 22 into first and second compartments 62 and 64. The first compartment 62 is defined by the partition, the long first end portion 52, the first end wall 24, and the short second end portion 58. The second compartment 64 is defined by the partition, the short second end portion 54, the second end wall 26, and the long first end portion 56. The thickness, gauge or ply of the partition will depend on the strength and weight parameters desired for the package as a whole and its surface characteristics will depend on various factors including the product. The angle between the partition and the narrow side walls may vary, depending on various factors including the size of the housing, the products to be contained within the housing, and the material of the partition.

Although the invention is not limited to any particular dimensions, an example of the dimensions of a cardboard embodiment for commercial uses to contain twenty-five pounds of rice may be as follows: length—12"; width—12"; and depth—7". The partition may have a length of 16⅞", a width of 7", a thickness of ¼", and an included angle between the partition and the long end portion 52, or 56, may be about 45°. Other perceived dimensional examples include a relatively small size of 4"×8"×6", for a nine grain cereal; a relatively large size of 36"×72"×54" for pet food and agricultural fertilizer pellets; and an arbitrary medium size of 14"×12"×6" that relates to no specific product or specific weight. The partition may vary in thickness from ⅛" to ⅜" although again these dimensions are not limiting.

The container 20 further includes first and second pairs of triangular baffles 70 and 72 (FIGS. 1–3) at opposite ends 42 and 44, and on opposite surfaces 48 and 50, of the partition 40. Thus, there are four baffles in all. Each baffle has an inner edge 74 integrally secured to the partition and extending across a corner thereof at its respective end of the partition, a first side edge 76 integrally secured to its adjacent wide side wall 28 or 30, a second side edge 78 integrally secured to its adjacent narrow side wall 32 or 34, and opposite first and second surfaces 80 and 82. The baffles of each pair of baffles converge endwardly of their respective ends 42 and 44 of the partition so that their endmost apices are in relatively closely spaced relation where they join their respective narrow side walls, as best seen in FIGS. 1 and 2. The baffles have surface characteristics like the partition and are preferably the same thickness as the partition. As such, each pair of baffles forms a funnel with its respective end 42 and 44 of the partition with the funnel converging or tapering endwardly of the partition and with the first surfaces 80 in effect forming converging end portions of the surfaces 48 and 50 of the partition, as will be more clearly understood as the description proceeds. It should be understood that the partition and baffles could be a unitary structure and simply made to provide a partition with funnels at its ends. It also is to be noted that the walls 24, 26, 28, 30, 32, 34; the flaps 25 and 27; the partition 40; and the baffles 70, may be coated with a liner indicated at 38 in FIG. 3, of waxed paper or plastic to help preserve the freshness of the product.

Figure 4:
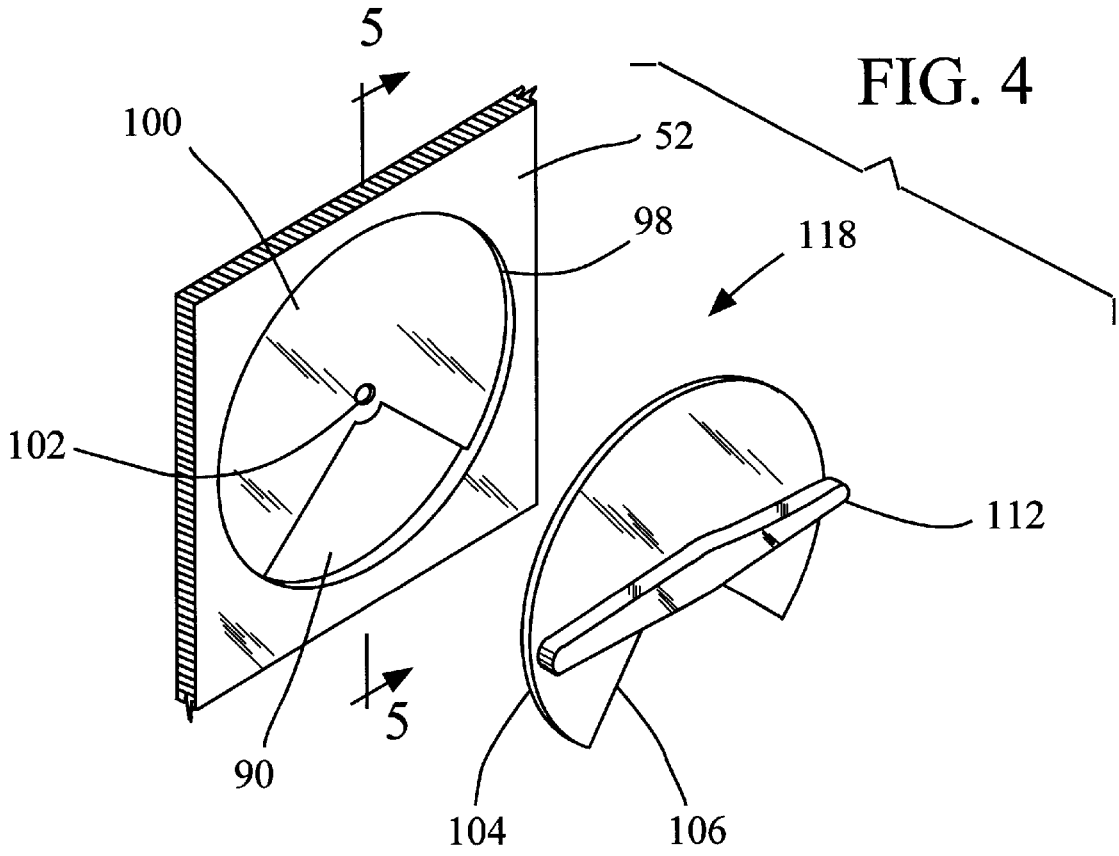
FIG. 4 is a enlarged, fragmentary exploded view of a rotary valve used in the container of FIGS. 1–3, with the valve members being in fully open positions.
Figure 5:
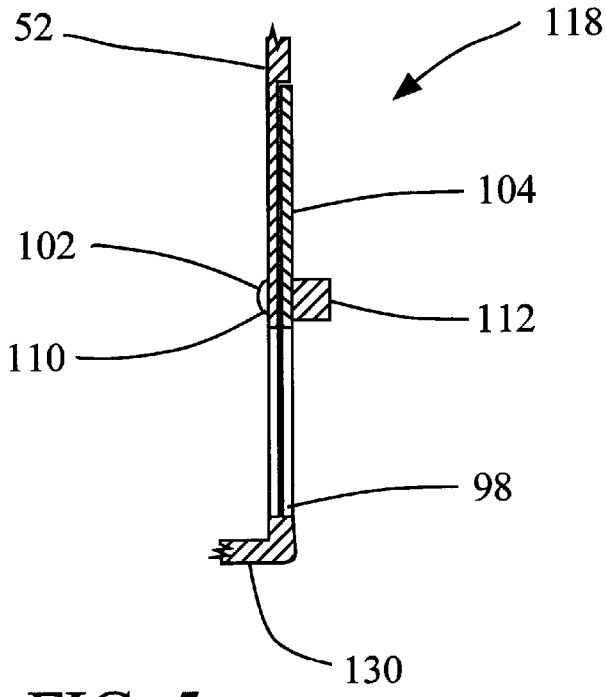
FIG. 5 is a fragmentary section taken on a plane indicated by line 5—5 in FIG. 4, but with the valve being assembled instead of exploded as shown in FIG. 4 and the valve members being in fully closed positions.

The first and second narrow side walls 32 and 34 (FIGS. 1–5) provide first and second outlets 90 and 92 in the long end portions of 52 and 56 of their respective narrow side walls. The outlets are located at the convergence of their respective pairs of baffles 70 and 72 and thus are located closely adjacent to the intersections of the ends 42 and 44 of the partition 40 with the respective narrow side walls. As best seen in FIGS. 2 and 4, each outlet is generally wedge-shaped with its arcurate edge subtending an arc of approximately 90° and with its sides in generally perpendicular relationship to their respective baffles, again as best seen in FIG. 2. With this relationship, each outlet is symmetrically disposed relative to its adjacent pair of baffles and thus to the terminus of the previously described funnel at its end 42 or 44 of the partition 40.

Each outlet 90 and 92 (FIGS. 1, 2, 4 and 5) is formed in a circular recess 98 (FIG. 4) of its respective long end portion 52 and 56. As such, a planar stationary valve member 100 subtending an arc of approximately 270° occupies the recess along with its respective outlet 90 or 92. The stationary valve member has a partially spherical central socket 102 (FIGS. 4 and 5) concentric with the recess and adjacent to the apex of the associated outlet. A planar rotary valve member 104 having a peripheral edge subtending an arc of approximately 270° is rotatably received in the recess 98 and provides a wedge-shaped outlet opening 106 subtending an arc of about 90°. The rotary valve member has a partly spherical hub 110 rotatably snap-fitted into the socket 102.

The rotary valve member 104 (FIGS. 1, 2, 4 and 5) is thus mounted within the recess 98 for rotation between open and closed positions. In the open positions, the outlet opening 106 of the rotary valve member is congruent with or at least partially overlapping the respective outlet 90 or 92. In the closed positions, the rotary valve member entirely or partially covers and blocks its respective outlet. A valve handle 112 is secured to the rotary valve member and extends diametrically thereof for enabling manual movement of the rotary valve member between its open and closed positions. Thus, it will be understood that the container 20 includes first and second rotary valves 118 and 120, each respectively comprising a stationary valve member 100, a rotary valve member 104, and a valve handle 112, for opening and closing the outlets 90 and 92. Although rotary valves are preferred, it will be understood by those skilled in the art that other types of valves might be employed, for example, a sliding type of valve.

With particular reference to FIGS. 1 and 3, the relationship of the partition 40 to the other parts of the housing 22 may be further explained as follows. In this embodiment of the invention the plane of the partition intersects the narrow side walls 32 and 34 inwardly of the end walls 24 and 26 and intersects the planes of the end walls laterally outwardly of the narrow side walls 32 and 34. Also, the partition may be described as being in oblique angular relationship to the narrow side walls as well as to the planes of the end walls. The partition is also described above as being an almost diagonal partition in that it comes close to but does not join the cater-comer vertices of the housing. Instead, it joins the opposed first and second narrow side walls closely adjacent to cater-corner vertices, as fully described and illustrated. Terms such as "slanted" or "inclined" or "sloping" may also be used to describe the orientation of the partition in the housing. In addition, and as partially alluded to before, the compartments 62 and 64 are in effect funnels that converge toward their respective outlets 90 and 92 by virtue of the partition 40 and the baffle pairs 70 and 72. The container may be thus thought of as being composed of two back-to-back funnels that are inverted relative to each other with the throats of the funnels being at opposite ends of the container and with the outlets of funnels being at their throats.

The container 20 (FIGS. 1–3) may or may not also include arcuate alcoves 130 and 132 formed in the short end portions 54 and 58 of the first and second narrow side walls 32 and 34. As illustrated, each alcove extends both longitudinally endwardly and radially inwardly of the container relative to its adjacent outlet 90 and 92. As best seen in FIG. 2, each alcove is symmetrical with its respective outlet, its adjacent pairs of baffles 70 and 72 and its respective valves 118 and 120. In other words, the funnels defined by the partition 40, the baffles, and the compartments 62 and 64 converge centrally toward their respective alcoves. Each alcove has an inner or back wall 134 and 136 that extends along an arc whose radius exceeds the radius of the outlets, whereby the diameter of the alcove is greater than the diameter of the outlet. If alcoves are not included, the second end portions 54, 58 are planar and are coplanar with their respective first end portions 52, 56.

OPERATION AND METHOD OF USE OF FIRST EMBODIMENT

Figure 7:
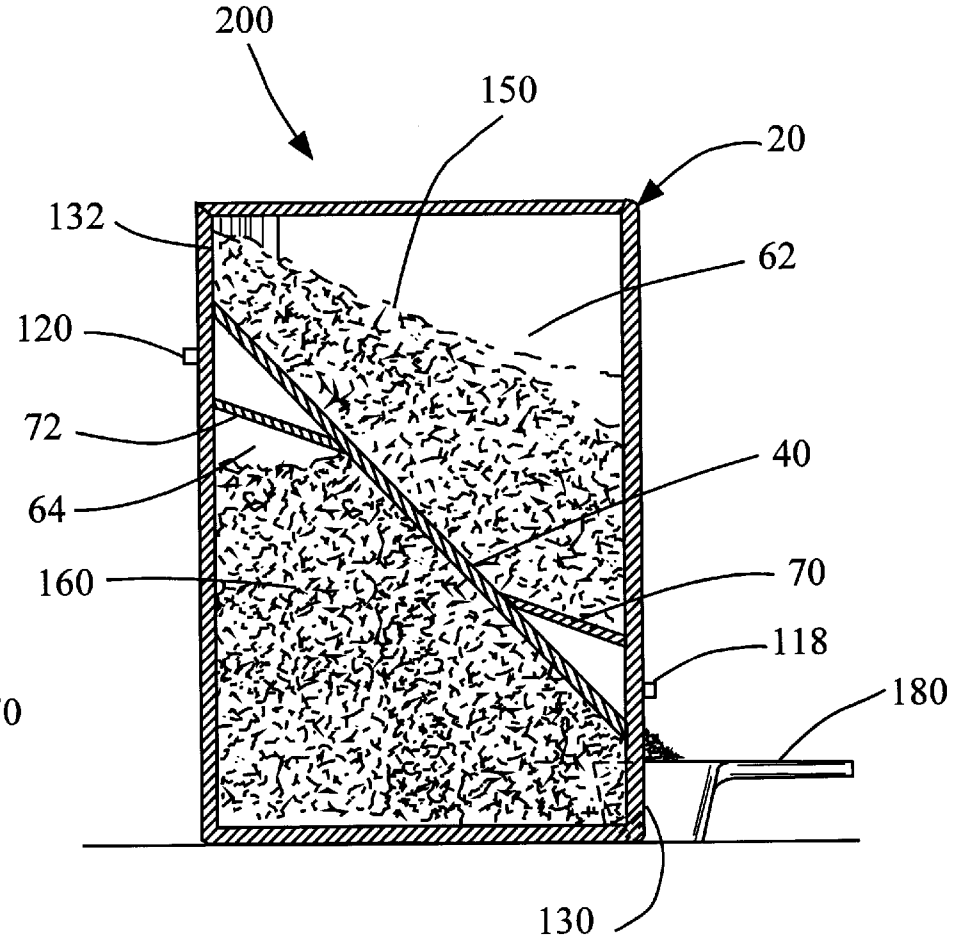
FIG. 7 is a view similar to FIG. 3 but with the side panel in the foreground removed so as to show product in both the upper and lower compartments, the product in the upper compartment being dispensed into the cup.
Figure 6:
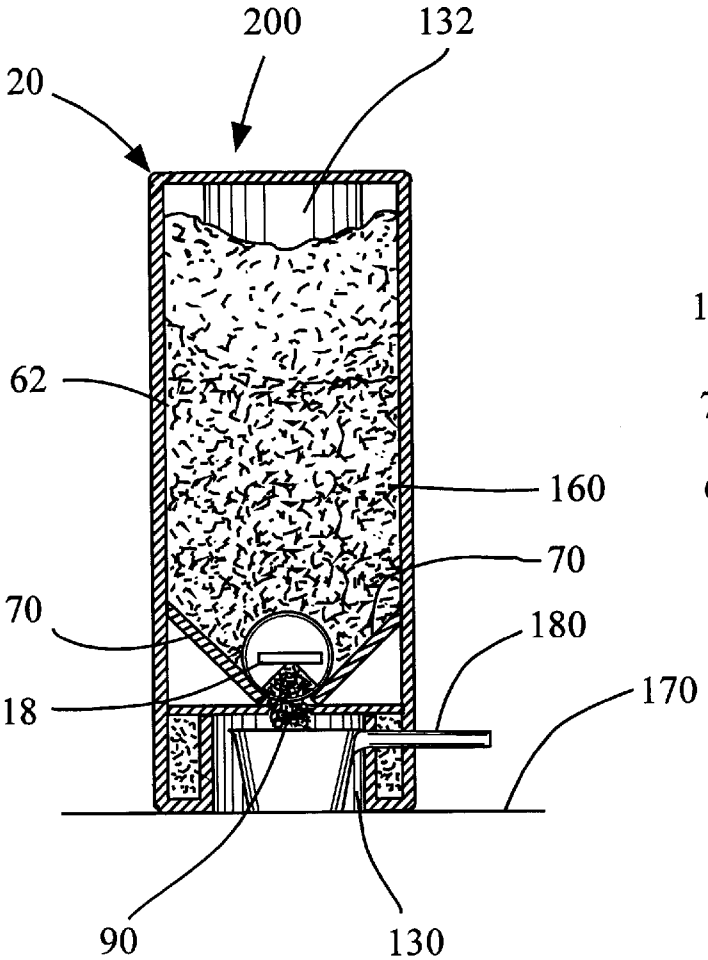
FIG. 6 is a view similar to FIG. 2 but with the front side panel in the foreground removed so as to show the dry, bulk product in the container being dispensed into a cup on the table.

With reference to FIGS. 1, 6 and 7, the compartments 62 and 64 of the container 20 may be filled with two different dry bulk products, such as raw uncooked rice as generally indicated by the number 150 in FIGS. 6 and 7 and raw uncooked beans as generally indicated by the number 160 in FIG. 6. Alternatively, each compartment may be filled with the same product. For the following description, however, different products will be assumed to be in the two compartments.

The compartments 62 and 64 (FIGS. 1–4, 6 and 7) may be filled with the products 150 and 160 before the flaps 25 and 27 are closed and sealed during the manufacturing process. Manufacturing processes and filling equipment are well known, are not part of the present invention, and therefore are not described in any detail. In manufacturing the container 20, the valves 118 and 120 are sealed shut as by applying a removable, transparent sealing patch, not shown, over the valve but in a well known manner. However, as one example of a package 200 of the container 20 and the products 150 and 160, approximately 12½ pounds of rice 150 may be placed in compartment 62 and approximately 12½ pounds of beans 160 may be placed in compartment 64. In this way, the total weight of the package including the container and its contents is approximately twenty-five pounds. Although such a weight is believed to be relatively optimum for convenient handling, the invention is not limited to any particular weight.

After the container 20 (FIGS. 1–7) has been filled and the flaps 25 and 27 have been closed and sealed, the package 200 comprising the container 20 and its contents 150 and 160 is ready for shipment by the manufacturer into the distribution chain, including wholesalers, retailers and ultimate users. During distribution, the containers of the subject invention are easier to handle than the typically currently used bags such as are used for rice and beans, since their rectilinear configuration enables compact placement in larger containers, on pallets, on display or storage shelves, or the like. Furthermore, because of their size, shape, material and integrated construction, the containers are less susceptible to puncture or invasion by pests so that the product receives greater protection in the distribution chain.

The advantages during distribution carry over to the user, which may be a restaurant or other organization that uses large quantities of the products 150 and 160. The restaurant may purchase several containers 20 (FIGS. 1–7) containing the rice and beans and store them on shelves which may be at convenient heights for subsequent access. Moreover, because of their uniform and rectilinear shapes, the containers can be stored in neatly stacked rows and columns or shelves thereby to conserve space. This is to be contrasted with the current method of purchasing rice and beans in bags ranging from twenty-five to fifty pounds which in many cases cannot be stored anywhere except on the floor in an inefficient use of space.

When the restaurant desires to use some of the product 150 and 160 in a container 20 (FIGS. 6 and 7), the container is placed with one of its end walls 24 and 26 on a table 170.

The container is positioned so that the compartment 62 or 64 containing the product that is desired is located above the other compartment containing the product not immediately desired. Thus, in the illustration of FIG. 7, rice 150 is the desired product and thus is located above the beans 160. In this position, the alcove 130 extends upwardly from the table, and the first outlet 90 is located in upwardly spaced relation to the table 170. Moreover, the height of the alcove is such that a cup 180 can easily be slid into the alcove under the outlet with both the container 20 and the cup resting on the table. As best seen in FIG. 7 and as above described, the alcove has a radius large enough to accommodate the diameter of the cup and so that approximately one-third of the cup fits in the alcove and the two-thirds of the cup is outside of the alcove. Following removal of the sealing patch, not shown, referred to above, the valve 118 is then opened, either partially or fully, by placing the outlet opening 106 either partially over or in exact congruent relationship with the first outlet. Thereupon, the rice product flows by gravity from the compartment 62 through the outlet into the cup, and when the cup is full or has received the desired amount, the valve is closed, thereby blocking further egress of product from the compartment.

Insofar as this example of dispensing rice product 150 from the first compartment is concerned, it will thus be understood that the slope of the partition 40 along with the funnel defined by partition and baffles 70 encourage such gravitational flow of the product through the outlet 90 into the cup. The character of the product, e.g. its moisture content, the slope of the partition, and the coefficient of friction of the respective surface 48 relative to the product are all factors that influence the flow of the product through the outlet. These factors along with the location of the outlet in the narrow side wall of the housing and the easily movable valve 118 give the user control over the rate of flow of the product into the cup. In other words, neither is it desired to have the product gravitate too rapidly or too slowly through the outlet, and in designing the container for particular applications, the factors noted above allow this flow rate to be adjusted to a reasonable rate for the product in the container.

If the user then desires to obtain some of the other product, for example beans 160 (FIG. 7) in this example, the user then inverts the container 20 so that the other end wall 24 now rests on the table 170. At the same time, the user may turn the housing around so that the other narrow side wall 34 is facing to the front or to the right in the same direction that the first narrow side wall 32 was facing when rice was being dispensed, as in FIG. 7. In such a position, the container and its contents look just like FIG. 7 although it will now be understood that the second compartment 64 and its contents of beans are on top and the first compartment 62 and its remaining content of rice 150 are on the bottom. In order to obtain a quantity of beans, the second outlet 92, which is now at the bottom, is opened, and a quantity of beans is allowed to gravitate into the waiting cup 180. As before, the flow is cut off by closing the second valve 120.

Although the foregoing example has assumed that different products 150 and 160 are in the compartments 62 and 64, it should be understood that the compartments may be filled with the same product. As such, the container 20 is filled, transported and dispensed in a manner similar to that described above. One of the basic advantages of the invention, however, irrespective of whether the compartments are filled with different products or the same product is that a product may be dispensed from its compartment without picking up the container and tilting it in the conventional way of dispensing a product from a container intended to be dispensed this way. With the present invention, assuming that the same product is in both compartments, product is dispensed from one compartment until the compartment is empty, and then the container is inverted, and the product in that compartment is dispensed until that compartment is empty. Besides not having to lift the container to obtain product, the multiple compartments help to preserve the freshness of the product since one side of the container remains sealed while product is dispensed from the other side of the container. Also, more control over the amount of product being dispensed is achieved by the cooperative action between the partition 40 and the valves 118 and 120.

After dispensing a desired quantity of product 150 or 160, the container 20 may be returned to its storage location. Both removing the container to obtain product and returning the container to its storage location are relatively easy to accomplish because the weight of the container when completely full is not excessive, e.g, approximately twenty-five pounds, not an excessive weight for anyone to handle. In addition, the amount of product desired is neatly dispensed into the cup 180 without overflow or spillage onto the table or onto other food preparations. Since the valves 118 and 120 are closed after each dispensing, effectively essentially sealing each of the compartments, the freshness of the product even in the compartment being emptied is greatly improved over the current practices with bags.

SECOND EMBODIMENT

Figure 8:
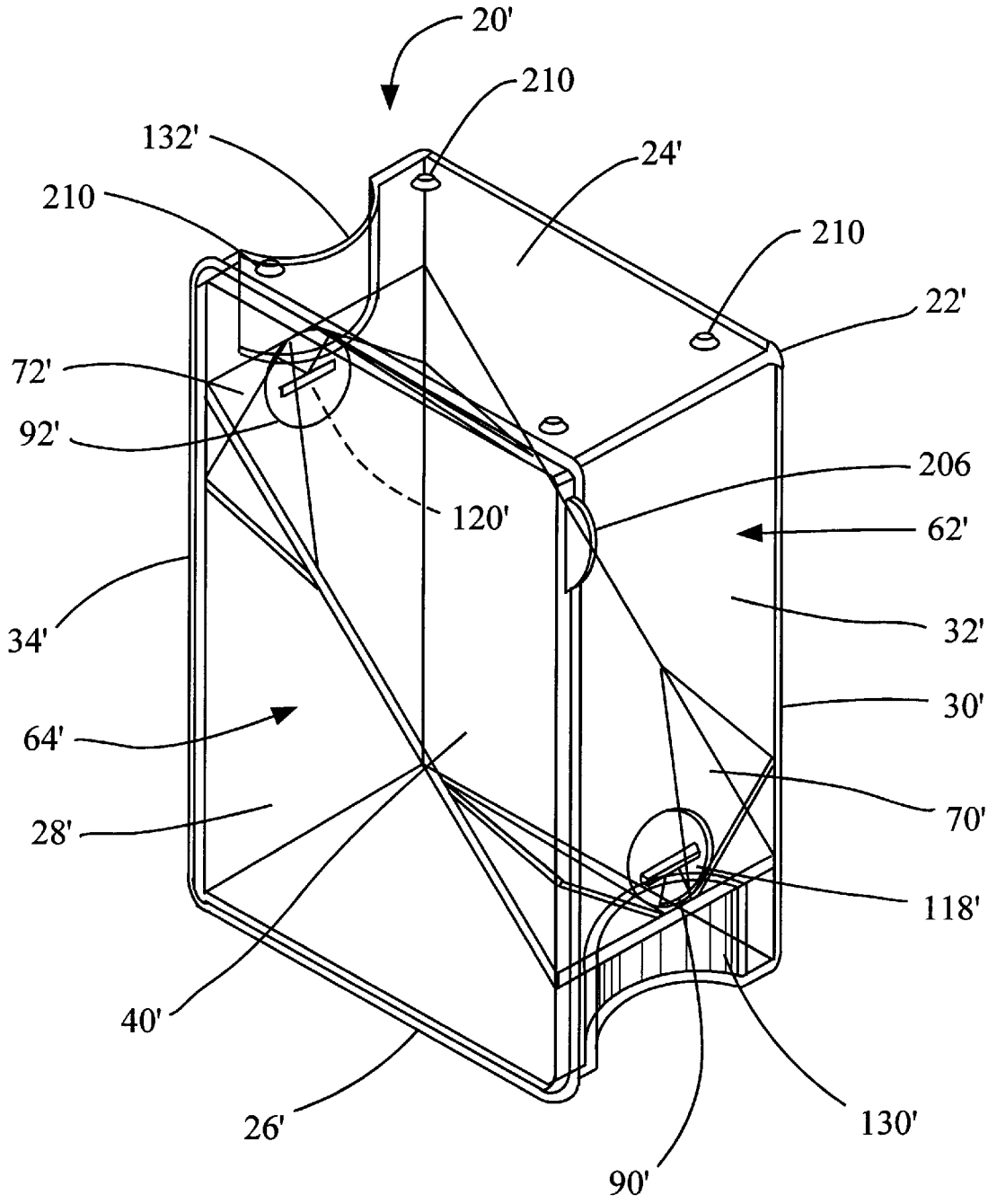
FIG. 8 is an isometric view similar to FIG. 1, but showing a second embodiment of a container incorporating the principles of the present invention, this embodiment being shown as transparent or translucent so that interior parts of the container can be seen.
Figure 9:
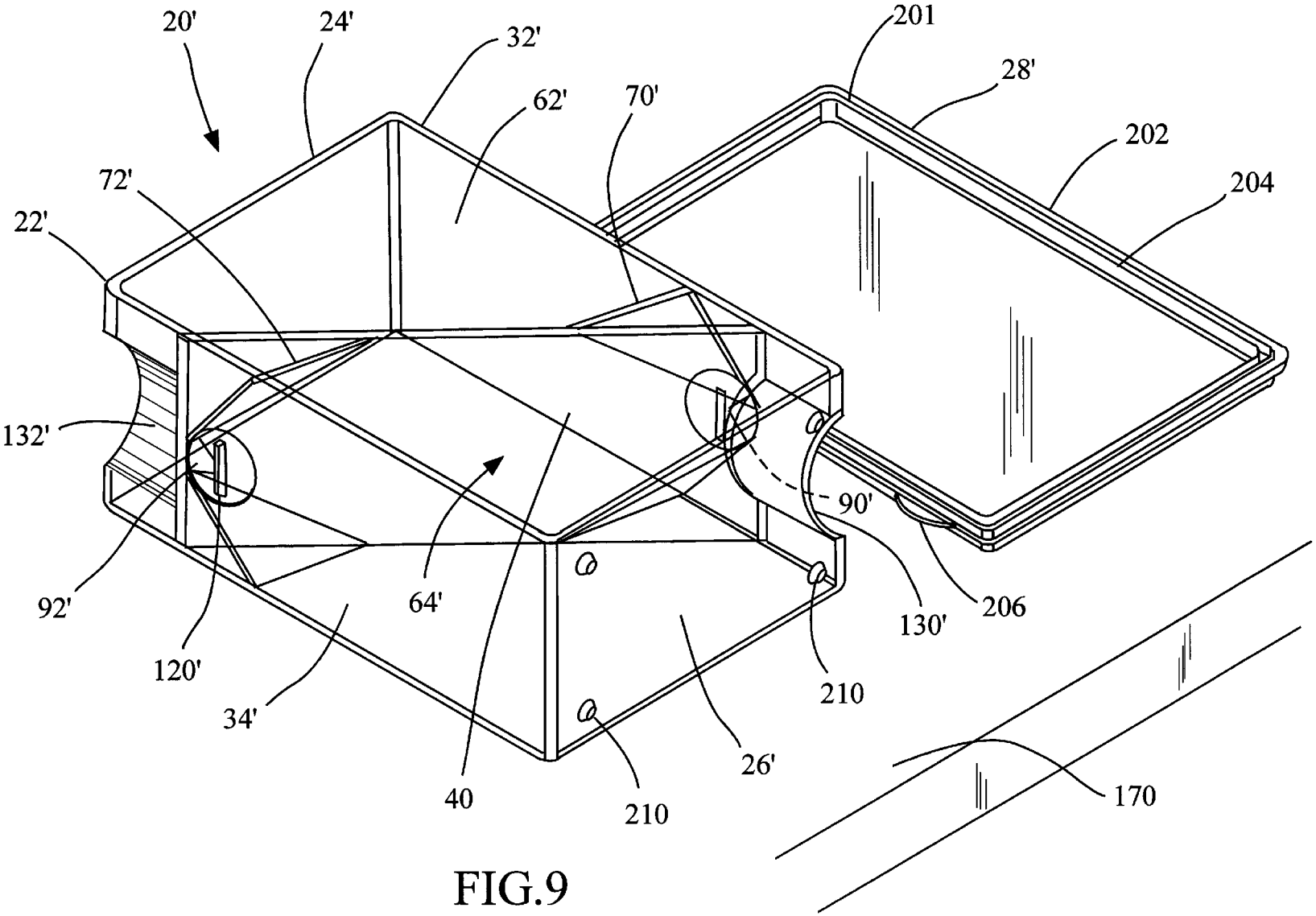
FIG. 9 is an isometric view of the container of FIG. 8 with the lid removed and lying on a table next to the housing of the container.
Figure 10:
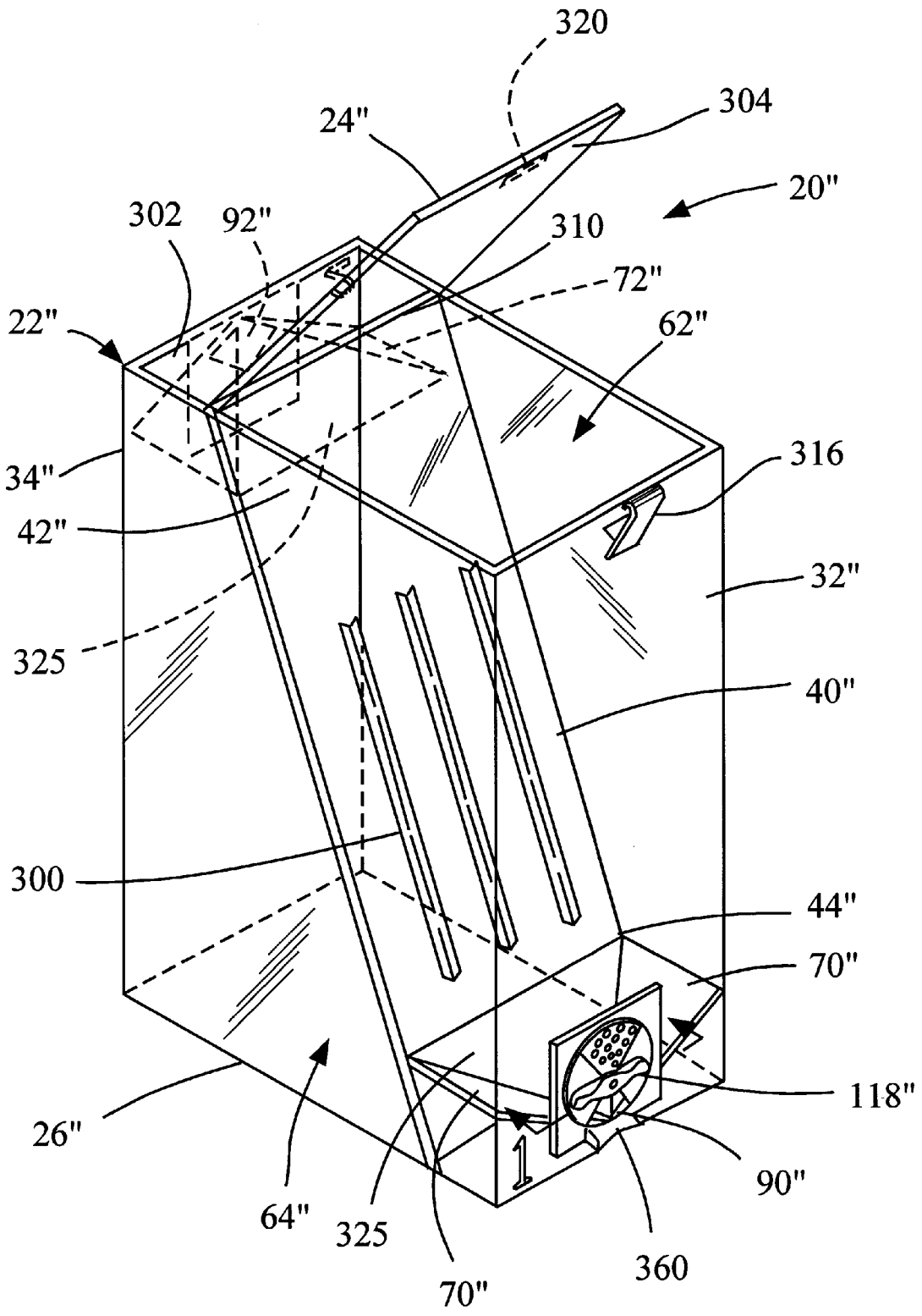
FIG. 10 is an isometric view similar to FIG. 1 but showing a third embodiment of a container incorporating the principles of the present invention, with one of the lids being shown open, and with the container being transparent so as to show interior parts, this third embodiment being identical to that disclosed in the above-cited related application, Ser. No. 09/065,151.
Figure 12:
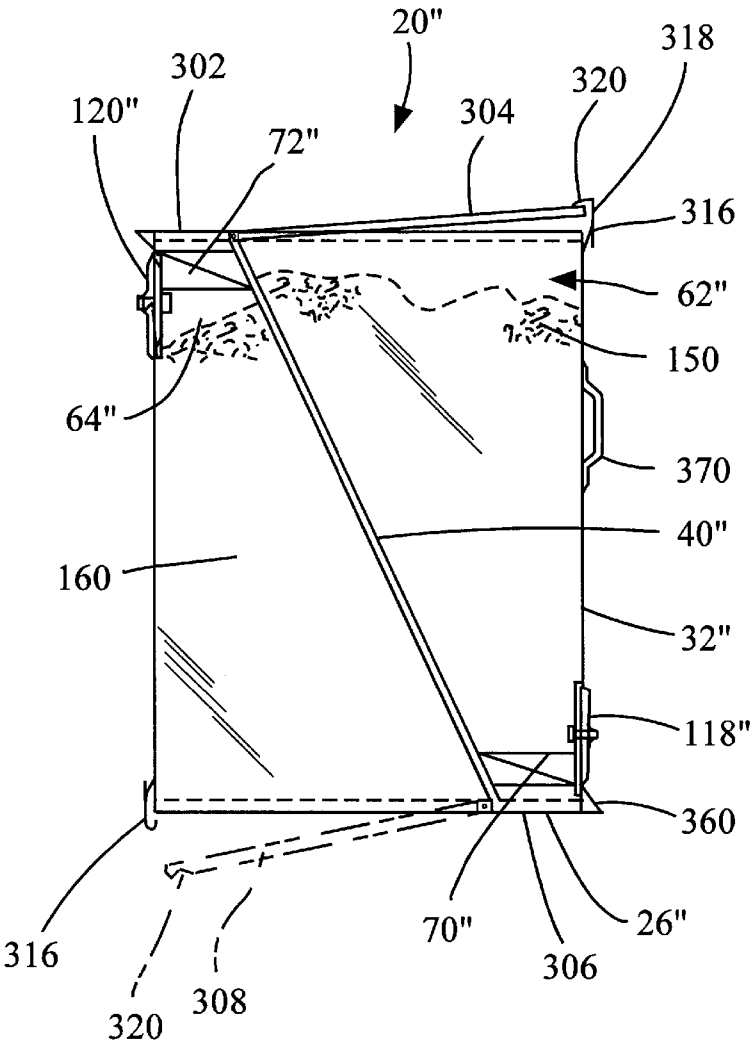
FIG. 12 is a side elevation of the left side of the container as seen in FIG. 11, with the upper lid being shown partially open in solid lines, with the lower lid being open to a greater degree but shown in dashed lines, and with products being shown in each compartment of the container.
Figure 11:
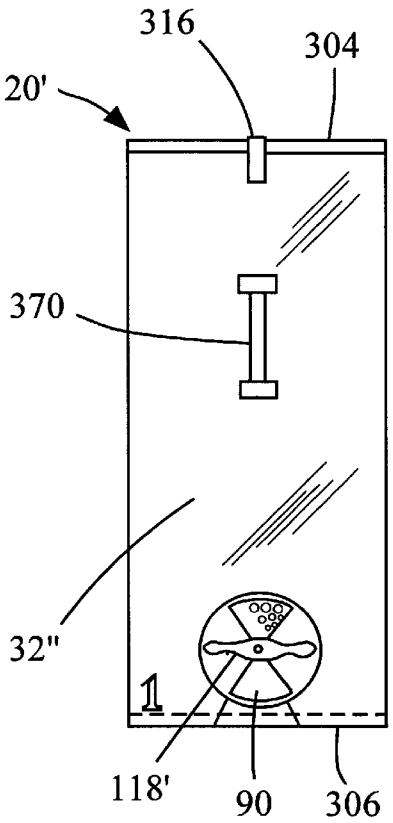
FIG. 11 is a side elevation of one side of the container shown in FIG. 10, which may be considered one of the front sides of the container, but on a scale somewhat reduced from that shown in FIG. 10.
Figure 13:
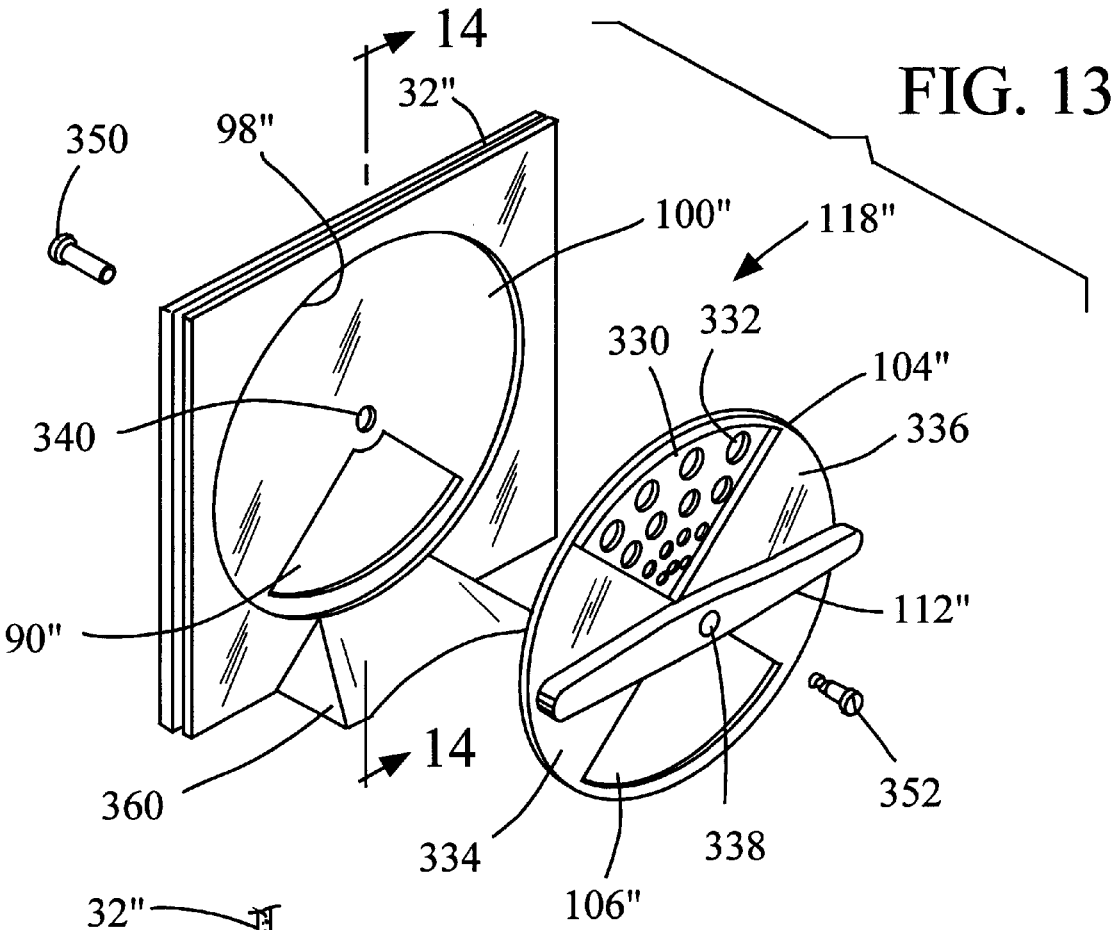
FIG. 13 is an exploded view similar to FIG. 4 but showing a second embodiment of a rotary valve as used in the container of the third embodiment of the subject invention, with the valve members being in fully open positions.
Figure 14:
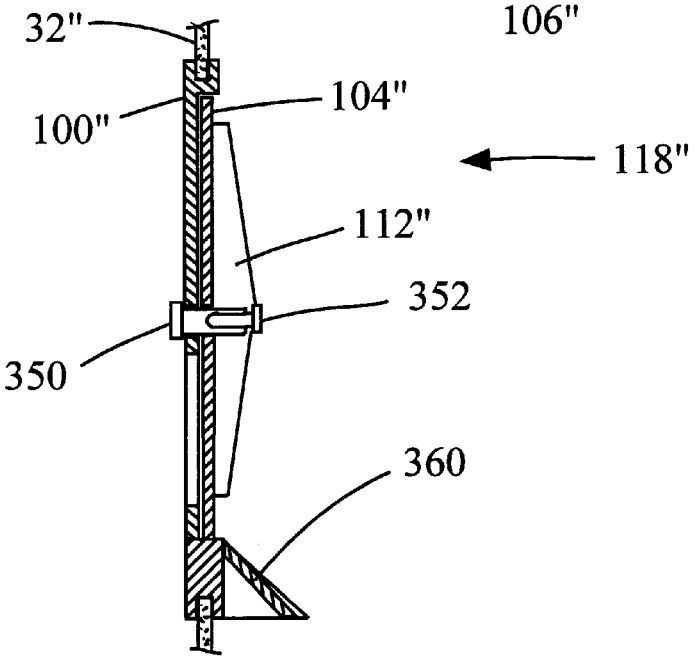
FIG. 14 is a fragmentary, enlarged cross section taken on a plane indicated by line 14—14 in FIG. 13 but with the valve assembled and fully closed.

A second embodiment of a container in accordance with the present invention is generally indicated by the number 20' in FIGS. 8 and 9. This container is the same as the first embodiment of the container 20 except for features that will now be described. Both containers 20 and 20' may be considered preferred embodiments for their particular applications. The container 20' is made of a plastic material, which may be of the same type of material that is used in the Tupperware or Rubbermaid containers. This container may be either transparent, translucent or opaque. For illustrative convenience, in FIGS. 8 and 9, the container is shown as transparent so that the interior parts may be seen and thus shown in full lines. Because of the similarity between container 20' and container 20, the parts of container 20' that are common with the container 20 will be numbered the same as the parts of container 20 but with a prime added. Moreover, no particular description will be provided for common parts, although they will be referred to in the drawings by their reference numbers.

In this second embodiment of the container 20' (FIGS. 8 and 9), the walls 24', 26', 30', 32', and 34' are all constructed in the same manner as their counterparts in container 20 except that they are of plastic instead of paperboard. As before, alcoves 130' may be omitted. The first wide side wall 28', however, is not integrally attached to the housing but is a removable lid, as best seen in FIG. 9. Again, this lid may be constructed in the manner of a Tupperware or Rubbermaid cover, and thus has a peripheral, U-shaped channel 201 that is of the size and shape of the rectangular edge of the housing formed by the narrow side walls 32' and 34' and the end walls 24' and 26', best shown in FIG. 9. The side wall or lid 30' fits on the housing in a closed position, as shown in FIG. 8, with the edge of the housing being sandwiched between the flanges 202 and 204 forming the channel 201 and thus being tightly frictionally but removably sealed to the housing. A tab 206 projects from one edge of the lid to facilitate removal of the lid from the housing. When removed, as shown in FIG. 9, the compartments 62' and 64' are fully exposed and accessible for filling, changing the contents, cleaning, and the like. Furthermore, this second embodiment of the container has four foot pads 210 secured or integrally molded on the outside surfaces of the end walls 24' and 26' to stabilize the position of the container when standing on a table as 170.

The container 20' (FIGS. 8 and 9) of the second embodiment is particularly suited for domestic use where one or a few such containers may be utilized by a household to be filled or refilled with the same or different products at different times. For example, in one use of the container, one cereal might be placed in the compartment 62' and another cereal placed in compartment 64'. These cereals are accessible by using the container 20' in the same manner as described above with the container 20. The container 20' is thus placed on a table with the desired product in the upper compartment and dispensed through the lower outlet 90' or 92' by opening its respective valve 118' or 120', as the case may be. The container is inverted to obtain the other product, as above described for container 20.

THIRD EMBODIMENT

The third embodiment of the subject container is generally indicated by the number 20" in FIGS. 10–14 and may be made of either paperboard or plastic as described with the first and second embodiments. This embodiment is similar to that of FIGS. 1–7 but differs somewhat in the location of the various parts. Again, common elements between the embodiments of FIGS. 1 and 10 will bear the same reference numbers but in the case of the third embodiment, the number will be followed by a double prime. Thus, the container 20" includes a housing 22", first and second wide and narrow side walls 28", 30", 32" and 34", similar to the first embodiment. The differences in this third embodiment are in the first and second end walls 24" and 26", in the partition 40", in the baffles 70" and 72", in the outlets 90" and 92", and in the valves 118" and 120".

The partition 40" (FIGS. 10 and 12) includes first and second ends 42" and 44" integrally secured to the first and second end walls 24" and 26" in inwardly spaced relation to the narrow side walls 32" and 34". This partition 40" also has a plurality of elongated strengthening ribs 300 extending lengthwise thereof in transversely spaced relation to each other. Accordingly, the first end wall is divided into a short stationary first section and a movable long second section 304 forming a lid. The second end wall 26' is also divided by the partition into a short first stationary section 306 and a longer movable second section 308 forming another lid. Each of the lids is hinged to its respective shorter section at 310 and 312. Overcenter latches 306 are attached to the narrow side walls 32" and 34" and have clasps 318 releasably fitting in grooves 320 in the outside surfaces of the long movable second sections or lids 304 and 308. Alternatively, if the container is made of plastic, the lids may be secured in closed positions similarly to the described in connection with the second embodiment 20'.

In this third embodiment (FIGS. 10–14), the narrow side walls 32" and 34" have outlets 90" and 92" located immediately adjacent to the end walls 24" and 26" and thus are not spaced inwardly from the end walls as with the first embodiment (FIG. 1–7), nor are alcoves provided. Each of the baffles 70" and 72" is of frusto-triangular shape having an outside edge integrally secured to an adjacent wide side wall 32" or 34" and side edges that converge inwardly of the container and are integrally attached to a third baffle 325 between each pair of baffles. The third baffle has an upper edge integrally attached to the partition and side edges integrally attached to the inner side edges of the side baffles. At each end of the partition, therefore, the three baffles form a funnel extension of the partition leading to the respective outlet 90" or 92".

The valves 118" and 120" (FIGS. 13 and 14) are very similar to the valves 118 and 120 of the first and second embodiments except that the rotary valve member 104" has a quadrant 106" forming an outlet opening, a perforated quadrant 330 having a plurality of apertures 332, and two solid quadrants 334 and 336 forming closures. Moreover, each stationary valve member 100" provides an axial hole 340 adjacent to its respective outlet 90" or 92". When each rotary valve member 104" is positioned in its recess 98", the hole 338 in the rotary valve member aligns with the hole 340 in the stationary valve member. A pivot pin 350 extends through the aligned holes, and a screw 352 is threaded into the pivot pin thereby to hold the valves 118" and 120" together but to allow rotation of the rotary valve member into opened and closed positions. In one open position, the outlet opening 106" is congruent with the outlet 90" or 92" in the container 20" and in another partially open position, the perforated segment 330 is aligned with the outlet. When either solid quadrant 334 or 336 is over the outlet, the outlet is of course fully closed. With this type of valve, the flow through the outlet can be reduced with the perforated segment, such as may be used with some dry products that may flow more rapidly through a completely open outlet.

The third embodiment of the container 20" also includes spouts 360 (FIGS. 10, 12 and 13) attached to the narrow side walls of 32" and 34" directly beneath the outlets 90" and 92" and thus beneath the valves 118" and 120". These spouts guide the flow of the product being dispensed from the outlet into a cup 180. Also, the third embodiment may include a handle 370 attached to one of the narrow side walls as 32, for convenience in carrying the container.

Such a handle 370 may also be incorporated in either of the first or second embodiments 20 or 20' of the invention if preferred. Furthermore, the numbers "1" and "2" may be embossed on the narrow side walls 32, 34, 32', 34', 32", 34" of each embodiment adjacent to their respective outlets 90, 92, 90', 92', 90", 92" to facilitate identification of the product being dispensed. For example, if the container is made of an opaque or translucent material, a user can keep track of which product is to be dispensed by associating the number "1" or "2" with the product on the dispensing side of the container. Alternatively, observation windows, not shown, may be provided in the walls to enable checking of the level of the product in each compartment 62 and 64.

It will be understood from the foregoing that the subject container improves the packaging of flowable products such as dry bulk products such as rice and beans, but also certain liquid products in that the container facilitates the transportation, storing, dispensing and other handling of flowable products in a container, either in commercial or domestic uses. Moreover, personnel using the container will find that the container is easier to store, carry and manipulate.

Of particular significance, the container is capable of containing multiple products in separate compartments or the same product in multiple compartments so that product can be dispensed from the container without picking it up and tilting it. If the same product is packaged in the container, the container needs to be picked up only once for dispensing purposes and then merely inverted to continue dispensing product. If different products are packaged, only one container need to be accessed and each product can be dispensed from its compartment without continually having to pick up and tilt the container.

The container 20 is particularly suited for use by restaurants that specialize in serving two different dry bulk products that must be dispensed in large quantities on a daily basis. The container has the ability to dispense dry bulk products merely by their gravitational flow, depending upon the particular characteristics of the products and especially their flow rates given certain angles of repose. Each compartment, as 62 and 64, can be fully emptied while the container is in a single position simply by allowing the product to flow gravitationally from the compartment, albeit with perhaps only minimal vibration as the compartment is nearly empty. Moreover, the container allows a measure of control over the flow rate from the container depending on the product to be dispensed. Although paperboard and plastic are the preferred materials disclosed above for use in making embodiments of the subject container, many other materials could be employed such as wood, glass, ceramic clay, stainless steel, or tin.

Although preferred embodiments of the present invention have been shown and described, various modifications, substitutions and equivalents may be used therein without departing from the spirit and scope of the invention. Accordingly, it is to be understood that the present invention has been described by way of illustration and not limitation

What is claimed is:

1. A container comprising:

a housing having opposed first and second end walls and opposed first and second side walls;

a partition in the housing dividing it into first and second compartments, each compartment being bordered by the partition and respective end and side walls, the partition having opposite first and second ends relatively adjacent to the first and second end walls, the first side wall providing a first outlet from the first compartment adjacent to the first end of the partition and the second side wall providing a second outlet from the second compartment adjacent to the second end of the partition, the outlets being thereby at opposite ends of the housings the first and second ends of the partition being respectively sloped toward the first and second outlets, the partition constituting means for causing flowable material in the housing to gravitate toward the lower outlet when the housing is oriented with the side walls in upstanding position; and first and second closures on the first and second outlets.

2. The container of claim 1, wherein the partition is planar and is in a plane that is in angular relation to the planes of the side walls.

3. The container of claim 1, wherein funnels are formed at opposite ends of the partition leading to their respectively adjacent outlets.

4. The container of claim 1, wherein the first and second outlets are respectively located in the first and second side walls.

5. The container of claim 4, wherein the first and second outlets are respectively located in inwardly spaced relation to the first and second end walls.

6. The container of claim 4, wherein the first and second outlets are respectively located immediately adjacent to the first and second end walls.

7. The container of claim 1, wherein the only access to the compartments is through the outlets.

8. The container of claim 1, wherein one of the side walls provides a filler opening for both of the compartments, and wherein there is a lid on the filler opening.

9. The container of claim 1, wherein one of the walls provides a first filler opening for the first compartment and one of the walls provides a second filler opening for the second compartment; and lids on the filler openings.

10. The container of claim 9, wherein the first and second filler openings are in the opposite end walls;

and wherein there are lids on each filler opening.

11. The container of claim 1, wherein the walls and the partition are planar;

wherein the plane of the partition intersects the planes of the side and end walls; and wherein the intersections of the planes of the partition and the end walls are disposed laterally outwardly of the intersections of the planes of the partition and the side walls.

12. The container of claim 1, wherein the walls and the partition are planar;

wherein the plane of the partition intersects the planes of the side and end walls; and wherein the intersections of the planes of the partition and the end walls are disposed laterally inwardly of the intersections of the planes of the partition and the side walls.

13. The container of claim 1, wherein the walls and partitions are paperboard.

14. The container of claim 1, wherein the walls and partitions are plastic.

15. The container of claim 1, wherein the container is opaque.

16. The container of claim 1, wherein the container is transparent.

17. The container of claim 1, wherein the container is translucent.

18. A container, comprising;

a housing providing a pair of back-to-back funnel-shaped compartments that are inverted relative to each other, the compartments having wide ends converging toward narrow discharge ends in which are provided laterally opening outlets, said outlets being thereby at opposite ends of the container; and closures on the outlets.

19. The container of claim 18, wherein the container is in the shape of a rectangular parallelepiped.

20. The container of claim 18, wherein a partition extends obliquely in the container between opposite ends thereof and separates one compartment from the other.

21. The container of claim 18, wherein the closures are valves.

22. The container of claim 21, wherein each valve is a rotary valve.

23. The container of claim 18, wherein there are alcoves in the container in endwardly adjacent relation to the outlets.

24. The container of claim 18, wherein the outlets are immediately adjacent to the opposite ends of the container.

25. The container of claim 18, wherein the compartments have funnels opening into their adjacent outlets; and wherein the outlets are symmetrical with their respective funnels.

26. The container of claim 25, wherein there are alcoves in the container in endwardly adjacent relation to the outlets and symmetrical with their respective funnels and outlets.

27. A container for containing and dispensing flowable products, comprising:

a housing having opposed first and second end walls and opposed first and second side walls;

a partition in the housing obliquely extending from one side wall to the other side wall, dividing the housing into first and second compartments, and having opposite first and second ends respectively in adjacent spaced relation to the first and second end walls, the first side wall having a first end portion extending from the partition to the first end wall and a second end portion extending from the partition to the second end wall, the second side wall having a first end portion extending from the partition to the first end wall and a second end portion extending from the partition to the second end wall, the first end portion of the first side wall having an outlet therein directly communicating with the first compartment and the second end portion of the second side wall having an outlet therein directly communicating with the second compartment, the outlets being respectively adjacent to the first and second ends of the partition, the first compartment being defined by the partition, the first end portion of the first side wall, the first end wall, and the first end portion of the second side wall, and the second compartment being defined by the partition, the second end portion of the second side wall, the second end wall, and the second end portion of the first side wall; and closures on the outlets, the second end of the partition and its adjacent outlet being lower than the first end of the partition in one position of the container such that the partition will cause flowable products in the first compartment will gravitate toward and out of the lower outlet when it is open.

28. The container of claim 27, wherein the walls and the partition are planar; and wherein the partition and each side wall are in planes that are in acute angular relation to each other.

29. The container of claim 27, wherein the walls and the partition are planar;

wherein the plane of the partition intersects the planes of the side and end walls; and wherein the intersections of the planes of the partition and the end walls are disposed laterally outwardly of the intersections of the planes of the partition of the side walls.

30. The container of claim 27, wherein the first and second outlets are respectively located in the first and second side walls in inwardly spaced relation to the junctures of the first and second end walls with the first and second side walls; and wherein each of the first and second side walls provides an alcove that extends radially inwardly of the container in endwardly adjacent relation to the outlets and extends lengthwise of the container to the adjacent end wall.

31. The container of claim 27, wherein one of the side walls is a lid removably attached to the other walls thereby providing a filler opening for the first and second compartments.

32. The container of claim 26, wherein the closures are valves.

33. The container of claim 32, wherein the valves are rotary valves.

34. A package, comprising;

a housing providing wall means and partition means dividing the housing into a pair of back-to-back funnel-shaped compartments that are inverted relative to each other and have laterally opening outlets at opposite ends of the container, the housing being movable so that either outlet can be placed above the other outlet;

flowable products in the compartments, the partition means causing product to flow toward the lower outlet from its compartment; and closures on the outlets.

35. The package of claim 34, wherein the products in the two compartments are different.

36. The package of claim 34, wherein the products are dry, flowable bulk products.

37. A container comprising:

a housing adapted to contain a flowable product therein and having multiple compartments and respective outlets from the compartments;

means for maintaining said product in the compartments and for enabling selective orientation of each compartment into a dispensing position wherein the product from that compartment can gravitationally flow through the outlets for that compartment without tilting the container; and valve means for closing and opening the outlets.

38. A method of dispensing product contained in separate compartments of a container having outlets from the compartments and wherein the product within each compartment is gravitationally urged toward its outlet when such outlet is downwardly disposed, comprising the steps of:

supporting the container in a first position wherein the outlet of one compartment is downwardly disposed;

opening the downwardly disposed outlet to allow product to flow from its respective compartment through said downwardly disposed outlet while the container remains in said first position;

closing the downwardly disposed outlet;

re-orienting the container into a second position wherein the outlet of another compartment is now downwardly disposed;

opening the now downwardly disposed outlet to allow product from its compartment to flow therethrough while the container remains in said second position; and closing the now downwardly disposed outlet.

39. The method of claim 38, wherein the re-orienting step involves inverting the container.

40. The method of claim 38, wherein the product in the two compartments is the same.

41. The method of claim 38, wherein the product in one compartment is different from the product in the other compartment.

42. The method of claim 38, wherein the product is dry and flowable.

43. The method of claim 38, including the further step of:

filling the compartments through the ends of the container.

44. The method of claim 38, wherein the compartments are filled through a side of the container.

45. The method of claim 38, including the further steps of:

supporting the container on a supporting surface prior to dispensing product from either compartment; and placing a receptacle on the supporting surface under the outlet from which product is to be dispensed.

46. The ornamental design for a container as shown and described.

47. The ornamental design for a package as shown and described.

48. A container comprising:

a housing having opposed first and second end walls and opposed first and second side walls;

a partition in the housing dividing it into first and second compartments, each compartment being bordered by the partition and respective end and side walls, the partition having opposite first and second ends relatively adjacent to the first and second end walls, the first side wall providing a first outlet from the first compartment adjacent to the first end of the partition and the second side wall providing a second outlet from the second compartment adjacent to the second end of the partition, each compartment and its outlet communicating with each other at the interface between the compartment and the side wall that provides the outlet, the first and second ends of the partition being respectively sloped toward the first and second outlets; and first and second closures on the first and second outlets.

49. A container for containing and dispensing flowable materials, comprising:

a housing having opposed first and second end walls and opposed first and second side walls;

a partition in the housing dividing it into first and second compartments, each compartment being bordered by the partition and respective end and side walls, the partition having opposite first and second ends relatively adjacent to the first and second end walls, one of the walls providing a first outlet from the first compartment adjacent to the first end of the partition and one of the walls providing a second outlet from the second compartment adjacent to the second end of the partition, the first and second ends of the partition being respectively sloped toward the first and second outlets and being disposed at an angle relative to the end walls such that flowable materials in the container will gravitate toward the lower outlet when the housing is disposed with the side walls in upstanding positions; and first and second closures on the first and second outlets.

50. A container for holding and dispensing flowable materials having an angle of repose, comprising:

a housing having opposed first and second end walls and opposed first and second side walls;

a partition in the housing dividing it into first and second compartments, each compartment being bordered by the partition and respective end and side walls, the partition having opposite first and second ends relatively adjacent to the first and second end walls, one of the walls providing a first outlet from the first compartment adjacent to the first end of the partition and one of the walls providing a second outlet from the second compartment adjacent to the second end of the partition, the partition being disposed in the housing at angle relative to the end wall that exceeds the angle of repose of the material in the container, the first and second ends of the partition being respectively sloped toward the first and second outlets; and first and second closures on the first and second outlets.

51. A container for containing and dispensing flowable contents of the container, comprising;

a housing providing a pair of back-to-back funnel-shaped compartments that are inverted relative to each other, that have laterally opening outlets at opposite ends of the container, and that are separated by sloped partition means that causes flowable contents in the container to gravitate toward an outlet when the outlet is vertically disposed and at the lower end of the partition means; and closures on the outlets.

* * * * *